US006857501B1

(12) United States Patent
Han et al.

(10) Patent No.: US 6,857,501 B1
(45) Date of Patent: Feb. 22, 2005

(54) METHOD OF FORMING PARYLENE-DIAPHRAGM PIEZOELECTRIC ACOUSTIC TRANSDUCERS

(75) Inventors: Cheol-Hyun Han, Fremont, CA (US); Eun Sok Kim, Torrance, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 82 days.

(21) Appl. No.: 10/089,008

(22) PCT Filed: Sep. 21, 2000

(86) PCT No.: PCT/US00/25962

§ 371 (c)(1),
(2), (4) Date: Mar. 21, 2002

(87) PCT Pub. No.: WO01/22776

PCT Pub. Date: Mar. 29, 2001

Related U.S. Application Data

(60) Provisional application No. 60/155,045, filed on Sep. 21, 1999.

(51) Int. Cl.[7] ..... H04R 7/00; H04R 31/00

(52) U.S. Cl. ..... 181/158; 181/164; 181/167; 381/173; 381/190; 381/191; 381/423; 381/426; 29/594; 216/2; 216/99

(58) Field of Search ..... 216/2, 99; 29/594; 181/158, 164, 167; 381/173, 184, 190, 191, 394, 395, 423, 426

(56) References Cited

U.S. PATENT DOCUMENTS

| | | | | |
|---|---|---|---|---|
| 4,607,145 A | | 8/1986 | Ravinet et al. | |
| 4,783,821 A | * | 11/1988 | Muller et al. | 381/173 |
| 5,209,118 A | * | 5/1993 | Jerman | 73/715 |
| 5,479,061 A | | 12/1995 | Bobbio et al. | |
| 5,490,220 A | * | 2/1996 | Loeppert | 381/355 |
| 5,870,351 A | * | 2/1999 | Ladabaum et al. | 367/163 |

FOREIGN PATENT DOCUMENTS

WO WO 99/24744 5/1999

* cited by examiner

*Primary Examiner*—Anita Alanko
(74) *Attorney, Agent, or Firm*—Fredric Zimmerman

(57) ABSTRACT

A micromachined acoustic transducer comprising a parylene diaphragm piezoelectric transducer. The parylene diaphragm has far lower stiffness than the silicon nitride. The method for fabricating the parylene diaphragm acoustic transducer utilizes a prestructured disphragm layer utilizing silicon nitride which is compatible with high temperature semiconductor process. A silicon nitride layer is patterned and partially removed after forming the parylene diaphragm layer in order to enhance the structural qualities of the parylene diaphragm. The diaphragm may be flat or dome-shaped.

19 Claims, 10 Drawing Sheets

METHOD OF FORMING PARYLENE-DIAPHRAGM PIEZOELECTRIC ACOUSTIC TRANSDUCERS

CROSS-REFERENCE TO A RELATED APPLICATION

The present application is based on a provisional application Ser. No. 60/155,045 filed Sep. 21, 1999, and entitled METHOD OF FORMING PARYLE DIAPHRAGM PIEZOELECTRIC ACOUSTIC TRANSDUCERS; this provisional application is incorporated herein by reference, and the priority of the provisional application is claimed herein.

FIELD OF THE INVENTION

The present invention relates to the micromachined acoustic transducers and their fabrication technology. More particularly this invention relates to parylene-diaphragm piezoelectric acoustic transducers on flat and dome-shaped diaphragm in silicon substrate.

BACKGROUND OF THE INVENTION

Recently, there has been increasing interest in micromachined acoustic transducers based on the following advantages: size miniaturization with extremely small weight, potentially low cost due to the batch processing, possibility of integrating transducers and circuits on a single chip, lack of transducer "ringing" due to small diaphragm mass. Especially, these advantages make the micromachined acoustic transducers, such as microphone and micro speaker, attractive in the applications for personal communication systems, multimedia systems, hearing aids and so on.

Micromachined acoustic transducers are provided with a thin diaphragm and several diaphragm materials that must be compatible with high temperature semiconductor process, such as silicon nitride and silicon have been utilized as diaphragm. However, micromachined acoustic transducers made by these conventional diaphragm materials suffer from a relatively low sensitivity and it is mainly because of the high stiffness and residual stress of these diaphragm materials.

In order to implement the micromachined acoustic transducers with competitive performance with conventional acoustic transducers, it is necessary to find new diaphragm materials that have low stiffness and compatibility with semiconductor processing at the same time. Also, the transducer should be designed to release or minimize the residual stress of the diaphragm.

SUMMARY OF THE INVENTION

The present invention relates to piezoelectric acoustic transducers and improved methods of making such transducers.

In accordance with one embodiment of the invention, the piezoelectric transducer is made of parylene; in accordance with a further embodiment of the invention, the parylene diaphragm is supported by a patterned silicon nitride layer.

In accordance with a further aspect of the invention, the diaphragm is made in accordance with a process utilizing a silicon nitride diaphragm layer which is compatible with high temperature semiconductor processing.

In summary, the present invention comprises a micromachined acoustic transducer comprising a parylene-diaphragm piezoelectric transducer. The parylene diaphragm has far lower stiffness than silicon nitride which has been the dominant technology for micromachined diaphragms, and provides higher performing acoustic devices. The parylene diaphragm is almost free from the residual stress problem, and considerably reduces transducer sensitivity.

The invention further comprises a method for fabricating the parylene diaphragm acoustic transducer utilizing a pre-structured diaphragm layer utilizing silicon nitride which is compatible with high temperature semiconductor process.

In a preferred embodiment, the silicon nitride layer is patterned and partially removed after forming the parylene diaphragm layer in order to enhance the structural qualities of the parylene diaphragm.

In a further refinement of the process, a shadow masking technique utilizing high deposition rate thermal evaporation for conformal deposition of a metal electrode on a dome-shaped parylene diaphragm is utilized.

In an especially preferred embodiment, the parylene diaphragm acoustic transducer is a dome-shaped diaphragm which especially provides the following advantages:

(1) a dome diaphragm releases residual stress in the diaphragm through its volumetric shrinking or expansion;

(2) a dome diaphragm piezoelectric transducer produces its flexural vibration effectively from an in-plane strain (produced by a piezoelectric film sitting on a dome diaphragm);

(3) a dome diaphragm transducer has a higher figure of merit (the product of the fundamental resonant frequency squared and the dc response) than a flat diaphragm based transducer.

Other features and advantages of the invention will become apparent to a person of skill in the art who studies the following description of the preferred and exemplary embodiments, given in association with the following figures.

DETAILED DESCRIPTION OF THE INVENTION

Figure 1A:
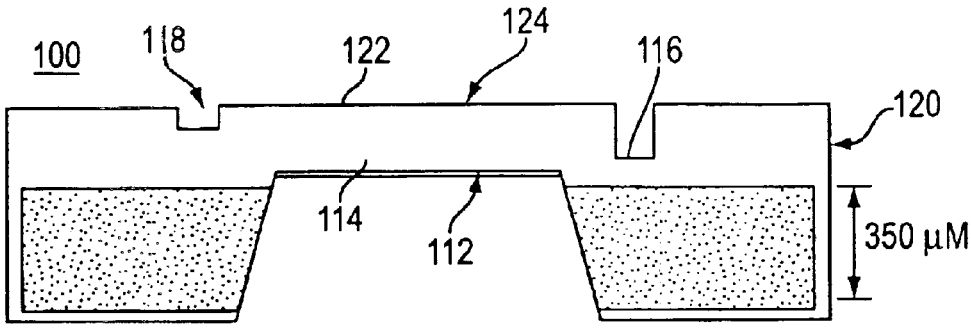
FIG. 1A is a cross-sectional view drawing of the parylene piezoelectric flat diaphragm acoustic transducer.

Microelectromechanical Systems (MEMS) technology has been used to fabricate tiny microphones and microspeakers on a silicon wafer. This method of fabricating acoustic transducers on a silicon wafer has the following advantages over the more traditional methods: potentially low cost due to the batch processing, possibility of integrating sensor and amplifier on a single chip, and size miniaturization. Furthermore, a thin-diaphragm-based miniature acoustic transducer has low vibration sensitivity due to the small diaphragm mass.

Compared to more popular condenser-type MEMS microphones, piezoelectric MEMS microphones are simpler to fabricate, free from any polarization-voltage requirement, and responsive over a wider dynamic range. However, a piezoelectric MEMS microphone suffers from a relatively low sensitivity, mainly due to high stiffness of the diaphragm materials used for the microphone. The thin film materials currently used for a diaphragm such as silicon nitride, silicon, and polysilicon were adopted because they are compatible with semiconductor processing techniques; but these materials have high stiffness and residual stress. High temperature semiconductor processing hinders the usage of more flexible materials such as polymer films as diaphragm materials, though many conventional bulky acoustic transducers use polymer diaphragm to improve the performance.

As a new approach for building micromachined acoustic transducers, parylene micromachined piezoelectric acoustic transducers are proposed. A parylene diaphragm that has about 100 times lower stiffness than silicon nitride, considerably increases the sensitivity at audio range compared with that of a conventional device made by silicon nitride diaphragm. Also, the parylene diaphragm is almost free of the residual stress problem which considerably reduces the sensitivity of prior art transducers.

Although parylene could be fabricated in either a flat or dome shape, a parylene piezoelectric dome-shaped diaphragm is especially useful, as it has the following advantages: it releases residual stress in the diaphragm through its volumetric shrinkage or expansion; it produces its flexural vibration effectively from an in-plane strain (produced by a piezoelectric film sitting on a dome diaphragm); and it has a higher figure of merit (the product of the fundamental resonant frequency squared and the dc response) than a flat diaphragm transducer. Therefore it generates ultrasonic sound effectively.

Fabrication

A. Parylene Flat Diaphragm Acoustic Transducer

A schematic of the process flow for the parylene micromachined piezoelectric flat diaphragm acoustic transducer (illustrated in FIGS. 1A–1C) is shown in FIG. 3. First, 1 $\mu$m thick low stress silicon nitride 300 is deposited by low pressure chemical vapor deposition (LPCVD) on a bare silicon substrate 302, followed by depositions of 0.5 $\mu$m thick bottom Al 304, 0.5 $\mu$m thick ZnO 306, 0.2 $\mu$m thick parylene 308, and 0.5 $\mu$m thick top Al 310. Then 1.5 $\mu$m thick parylene 312 is deposited as a diaphragm. Contact holes 314 are patterned through bottom and top electrode 304, 310 which are provided by the Al. To release the diaphragm structure, backside silicon nitride 320 is patterned, and silicon substrate 302 is removed by KOH etching. Finally, the silicon nitride 330 most bottom layer of diaphragm structure is either completely removed for the parylene flat-diaphragm acoustic transducers or selectively patterned for the parylene-held cantilever-like-diaphragm acoustic transducers.

Figure 1B:
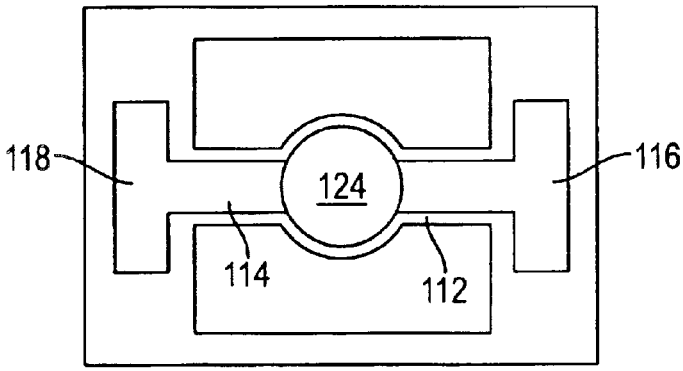
FIG. 1B is a top view of a fabricated parylene flat diaphragm acoustic transducer.
Figure 1C:
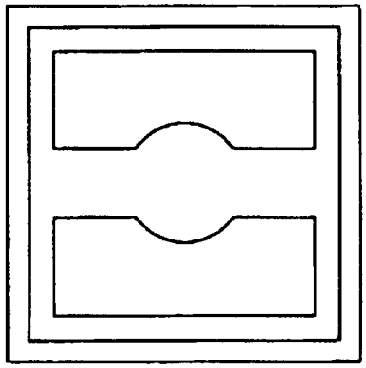
FIG. 1C is a bottom view of the parylene flat diaphragm acoustic transducer.

The completed transducer 100 is shown in FIGS. 1A–1C. FIG. 1A shows the layers of the transducer in cross-section, including the Al contact layers 112, 114 to contact 116, 118; the ZnO layer 120 which is provided to establish the desired transducer function; the thin insulating parylene layer 122 which separates the electrodes; and the parylene diaphragm layer 124. Several of these layers also appear in FIGS. 1B and 1C, top and bottom views, respectively.

The parylene-held cantilever-like-diaphragm transducer formed by selectively patterning bottom $Si_xN_y$ appears especially in FIGS. 3E–3H.

B. Parylene Dome-Shaped Diaphragm Acoustic Transducer

Figure 2A:
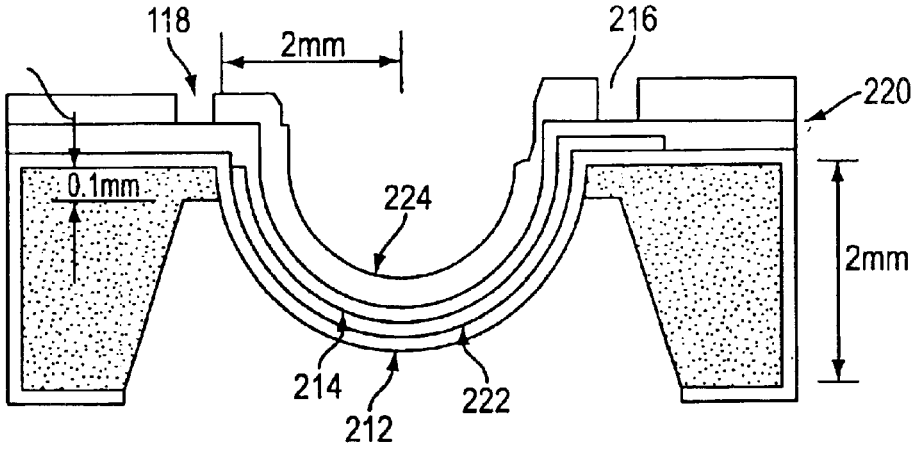
FIG. 2A is a cross-sectional view drawing of the parylene piezoelectric dome-shaped diaphragm acoustic transducer.
Figure 2B:
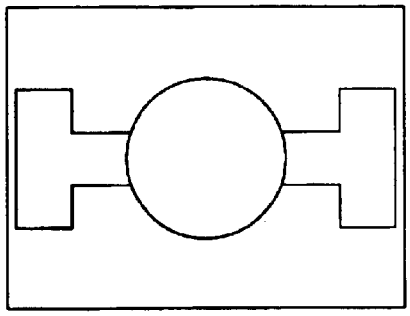
FIG. 2B is a top view of the parylene piezoelectric dome-shaped diaphragm acoustic transducer.
Figure 2C:
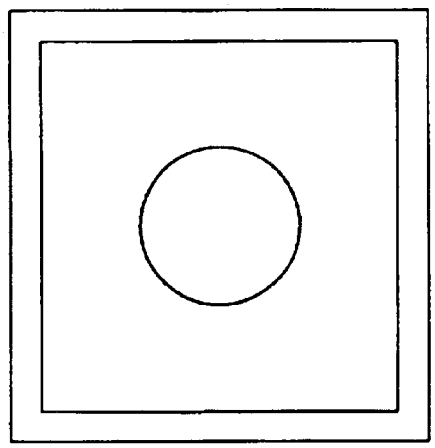
FIG. 2C is a bottom view of the parylene piezoelectric dome-shaped diaphragm acoustic transducer.
Figure 3A:
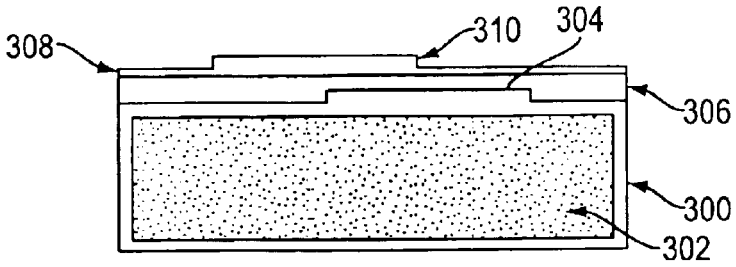
FIGS. 3A–3H are the processing steps to fabricate the parylene flat-diaphragm acoustic transducers and the parylene-held cantilever-like-diaphragm acoustic transducers.
Figure 3B:
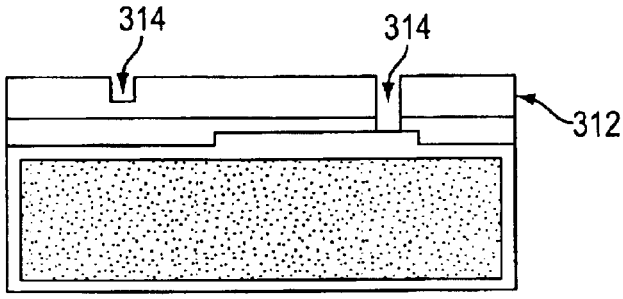
Figure 3C:
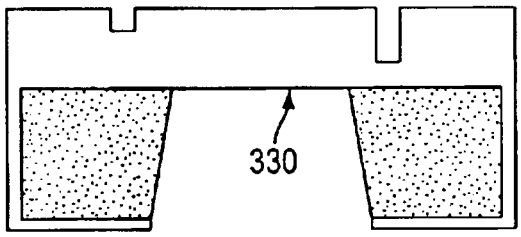
Figure 3D:
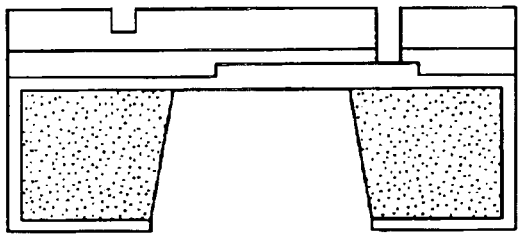
Figure 3E:
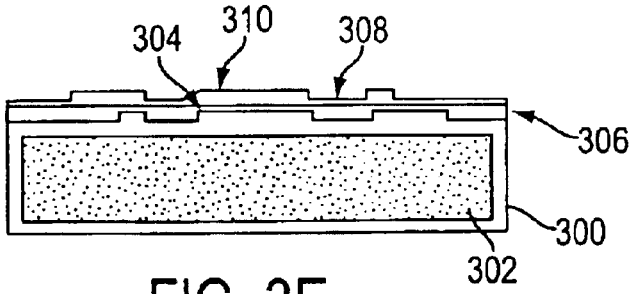
Figure 3F:
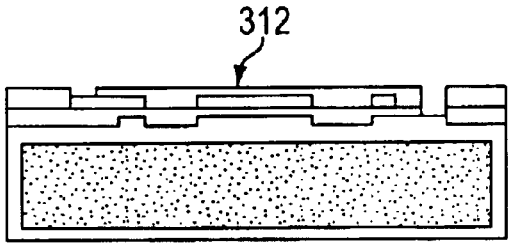
Figure 3G:
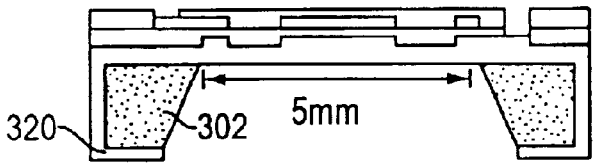
Figure 3H:
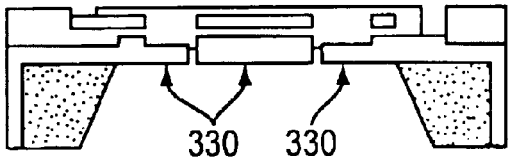

A schematic of the process flow for the parylene micromachined piezoelectric dome-shaped diaphragm acoustic transducer is 200 which is shown in FIGS. 2A–2C is shown in FIG. 4. First, 1 $\mu$m thick low stress silicon nitride 402 is deposited by low pressure chemical vapor deposition (LPCVD) on a bare silicon substrate 400 to prevent any possible contamination from the polyethylene tape used in subsequent processing steps. Also, this silicon nitride layer 402 functions as an etch mask in during a secondary isotropic etch of the silicon substrate (which is a step to improve the etch-front circularity and smoothness simultaneously). A polyethylene tape 404 is then pasted on the silicon nitride 402, and patterned in a reactive ion etcher (RIE) with Oxygen plasma (in this RIE step, Al 406 is used as an etch mask). After patterning the tape (FIG. 4B), the Al film is removed by an Al etchant (1 g KOH: 10 g K3Fe (CN)6: 100 ml Dl water) which rarely deteriorates the tape adhesion. Tape is then used to cover the bottom and side areas. Then the silicon 400 is etched (FIG. 4C) in an isotropic silicon etchant to form spherical etch fronts, followed by dissolving the polyethylene tape 404 in toluene. The etching may be performed in a Teflon beaker (without any agitation for uniform etch-stop effect) which is placed in a 50° C. water bath.

Figure 4A:
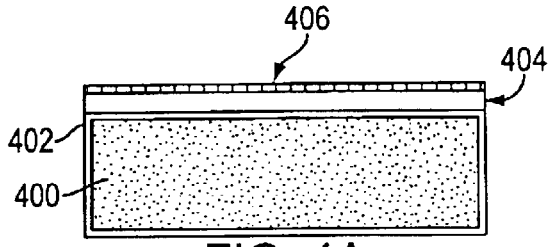
FIGS. 4A–4H show the processing steps to fabricate the parylene piezoelectric dome-shaped diaphragm acoustic transducer with the shadow-mask patterning method.
Figure 4B:
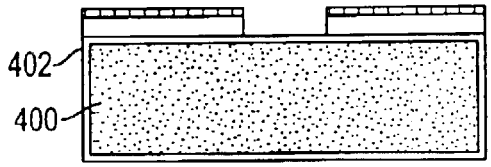
Figure 4C:
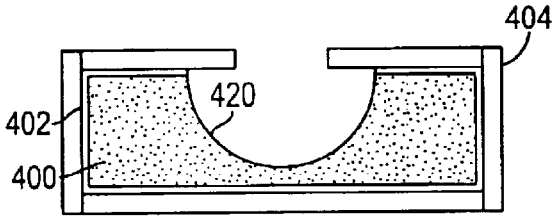
Figure 4D:
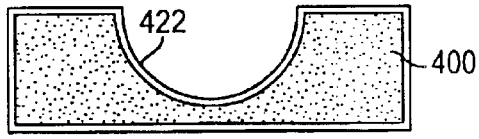
Figure 4E:
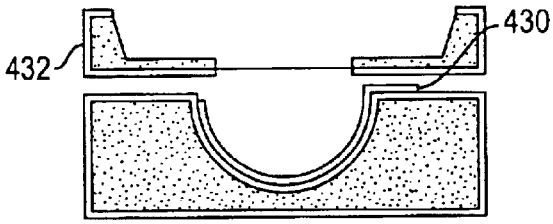
Figure 4F:
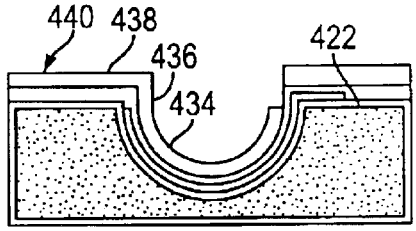
Figure 4G:
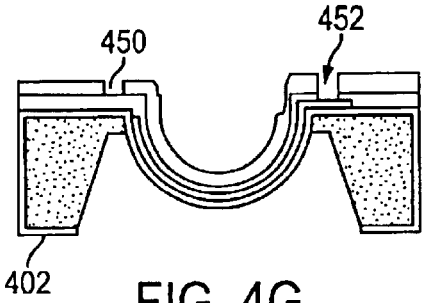
Figure 4H:
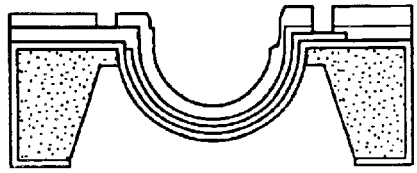
Figure 5A:
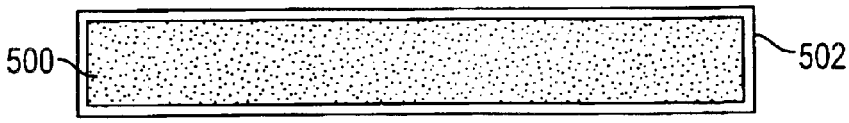
FIGS. 5A–5F show the processing steps to fabricate the shadow mask using anisotropic and isotropic etching technique.
Figure 5B:
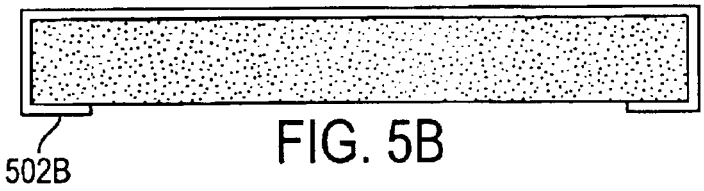
Figure 5C:
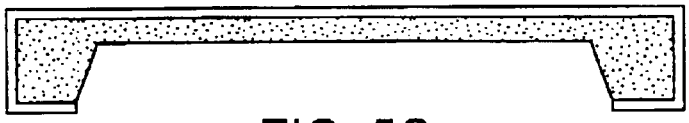
Figure 5D:
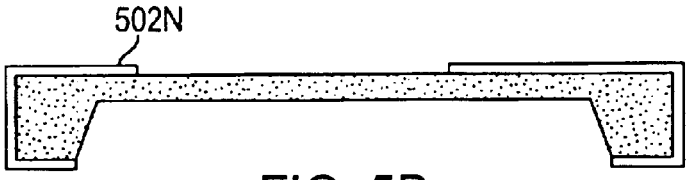
Figure 5E:
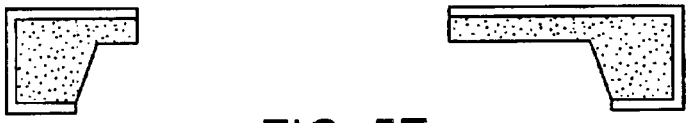
Figure 5F:
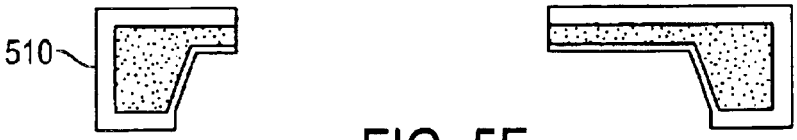

An additional isotropic etching after removing the polyethylene tape (Step 9) may be needed to improve the circularity and surface roughness of the etch front which is to serve as a mold to define the dome diaphragm. After obtaining the dome-shaped etch cavity, 1.5 $\mu$m thick slightly-compressive silicon nitride 422 is deposited on the wafer. Then a 0.5 $\mu$m thick bottom Al 430 is deposited with thermal evaporation by using shadow mask technique illustrated by mask 432 (FIG. 4E). This is followed by 0.5 $\mu$m thick ZnO 434, 0.2 $\mu$m thick parylene 436, and 0.5 $\mu$m thick top Al 438 deposited (FIG. 4F) with thermal evaporation by using shadow mask technique again. Then 1.5 $\mu$m thick parylene 440 is deposited as parylene diaphragm layer. Next contact holes 450, 452 (FIG. 4B) are patterned through bottom and top aluminum electrode. To release the diaphragm structure (FIG. 4H), silicon substrate 400 is removed by KOH etching after backside silicon is patterned. Finally, the silicon nitride most bottom layer 422 of diaphragm structure is either completely removed for the parylene flat-diaphragm transducers or selectively patterned for the parylene-held cantilever-like-diaphragm transducers.

The sequence of layers is the same as explained in FIG. 1A, including patterned SiN 210; Al contact layers 112, 114 leading to contacts 116, 118; ZnO layer 120; thin parylene insulating layer 122; and parylene diaphragm layer 224.

Shadow Mask Technique with High Deposition Rate Thermal Evaporation

In order to get high resolution patterning in dome-shaped diaphragm and avoid disconnection problem of electrodes at a sharp edge boundary, a shadow mask technique with high deposition-rate thermal evaporation has been developed.

High resolution patterning in non-planar substrate surfaces is an often-encountered problem in a micromachined process. It is because that conventional patterning method with spin coating of photoresist can not be used. Even if conformal photoresist coating method, such as PEPR2400, is used, the patterning should be limited by the step angle of substrate surface. That is, sharp edges are still hard to pattern because the effective thickness of photoresist is too thick and the light source does not penetrate underneath photoresist.

The shadow mask of FIG. 5 is made of a <100> oriented 3-inch silicon wafer 600. FIG. 5 illustrates the fabrication steps of the shadow mask using anisotropic and isotropic etching. First, 1 $\mu$m silicon nitride 502 is deposited (FIG. 5A) on the silicon substrate 500 and the backside silicon nitride 502B is patterned (FIG. 5B). Then silicon is removed (FIG. 5C) to thin the silicon substrate to about 10 $\mu$m by KOH etching. Next (FIG. 5D) front side silicon nitride 502N is patterned to define the shadow pattern. The wafer is immersed into isotropic etchant (composed of HF, $HNO_2$, and acetic acid with a ratio of 1:4:3) at room temperature; (FIG. 5E) the silicon membrane is etched from both of front and backside until the shadow pattern is clearly visible. To harden the shadow mask (protecting the fracture), 5 $\mu$m thick conformal parylene film 510 is deposited (FIG. 5F).

The shadow mask is bonded with photoresist after aligning onto substrate. Then thermal evaporation is done with high deposition rate (about 50 A/sec) in order to get CVDA-like conformal deposition as shown in FIG. 4E. In this high deposition rate, the deposition pressure is 3E-3 torr and mean free path of the aluminum vapor atoms (1.7 cm) becomes much smaller than the distance of the source to the substrates (25 cm).

Figure 6:
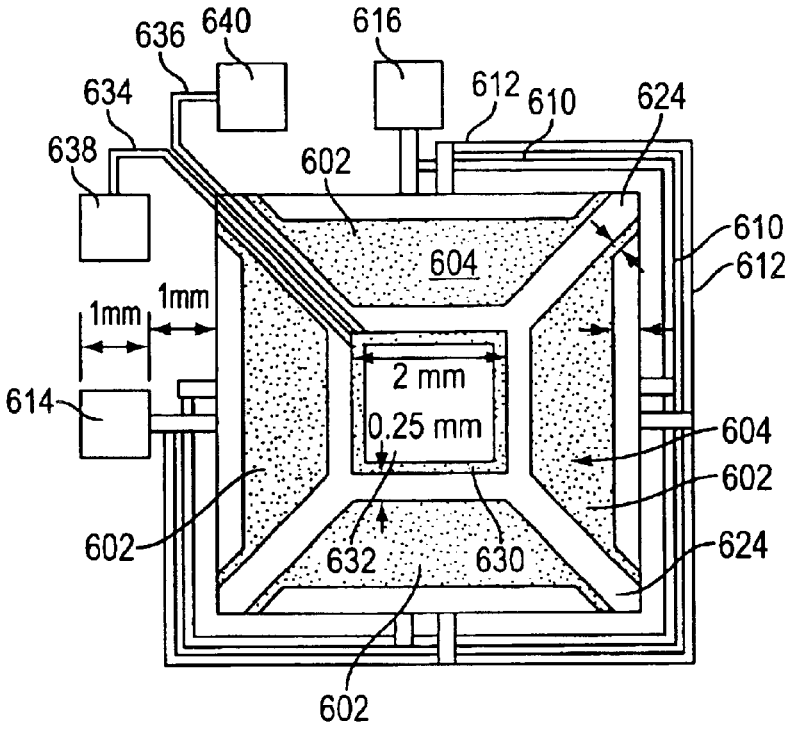
FIGS. 6, 7, 8, 9A–9C and 10A–10B illustrate various cantilever type parylene diaphragm acoustic transducers which can be fabricated using the technology described above.

In addition to the above, a technique to fabricate a cantilever-like diaphragm that releases the residual stress (and also is mechanically flexible) much like a cantilever, and yet is itself a diaphragm with its four edged clamped is described. Using the high mechanical flexibility (i.e., extremely low Young's Modulus) of parylene as a holding layer, various piezoelectric acoustic transducers built on silicon nitride layer (either in cantilever form and/or freely-suspended island form) with electrodes and piezoelectric ZnO film can be fabricated. The cantilevers and island are held together by a 1 $\mu$m thick parylene to form a flat diaphragm, similar to what is shown in FIG. 6, which shows a device comprising four cantilever structures near the edges and one floating island structure at the center.

Since parylene has a relatively low melting point (around 280° C. for parylene C), a parylene holding layer is deposited toward the end of the fabrication process after processing all the high temperature steps. The contact holes are opened through the parylene layer for access to the top and bottom electrodes. Then, after releasing the diaphragm with KOH etching, the silicon nitride is patterned from the backside with a reactive ion etcher (RIE) using photoresist as a mask layer. In order to spin-coat photoresist on the backside of a wafer that has released diaphragms with large topography, the front side of the wafer can be glued onto a bare dummy wafer with a double-side tape. Then letting the dummy wafer take the vacuum pressure of the photoresist spinner, the backside of the device wafer is coated with photoresist. The dummy wafer is detached before the exposed photoresist is developed (by applying isopropyl alcohol at the tape ends). This way, the silicon nitride is successfully patterned from the backside without damaging the released diaphragms.

Parylene micromachined piezoelectric acoustic transducers can be fabricated on a 1.5 $\mu$m thick flat and dome-shaped parylene diaphragm (5,000 $\mu m^2$ for flat square diaphragm and 2,000 $\mu$m in radius with a circular clamped boundary for dome-shaped diaphragm) with electrodes and a piezoelectric ZnO film. Parylene devices are utilized as a microphone and micro speaker.

A parylene diaphragm has about 100 times lower stiffness than silicon nitride, considerably increasing the sensitivity at audio range comparing with conventional device made by silicon nitride diaphragm.

In order to make parylene compatible with high temperature micromachining process, pre-structure process with silicon nitride has been utilized.

The parylene piezoelectric dome-shaped diaphragm has the following advantages: releasing residual stress in the diaphragm through its volumetric shrinkage or expansion, producing its flexural vibration effectively from an in-plane strain (produced by a piezoelectric film sitting on a dome diaphragm), and increasing the figure of merit (the product of the fundamental resonant frequency squared and the dc response) based on the structural stiffness of dome so generating ultrasonic sound effectively.

To pattern the aluminum electrode on 3-dimensional structure, shadow mask method with high deposition rate thermal evaporation has been successfully used to solve the discontinuity patterning problem at a sharp boundary edge of dome-shaped diaphragm structure.

The next succeeding figures show some additional structures which can be fabricated using the processes shown in FIG. 3, and which utilize the parylene as a substrate to support one or more cantilever-shape transducers. Such cantilever-shape transducers have the advantage that they are connected to the supporting silicon substrate structure only on one side with the other sides being free to move. This puts all the stress concentrated on a single edge, so that as the transducer is flexed, it can be easier to convert these changes in shape to an electrical signal. Therefore, referring for example to the multi-cantilever design of FIG. 6, this design includes the parylene diaphragm 624 which is co-extensive with the outline of the diaphragm. In this case, four cantilever-type transducers 602 are provided, each comprising a silicon nitride layer 604 under the parylene diaphragm and, along the edge, electrode connection regions comprising the layers of silicon nitride, zinc oxide, ZnO, the top and bottom electrodes 610, 612 and an insulating layer which is shown in FIGS. 1A and 2A. Electrode connectors 614, 616 provide the necessary connections to these electrode regions of each cantilever transducer. The center section also includes an SiN layer 630 which is generally rectangular in shape and partially overlying that area a silicon nitride SiN layer 632 as well as the electrode connections 634, 636 to separate external electrodes 638, 640.

Figure 7:
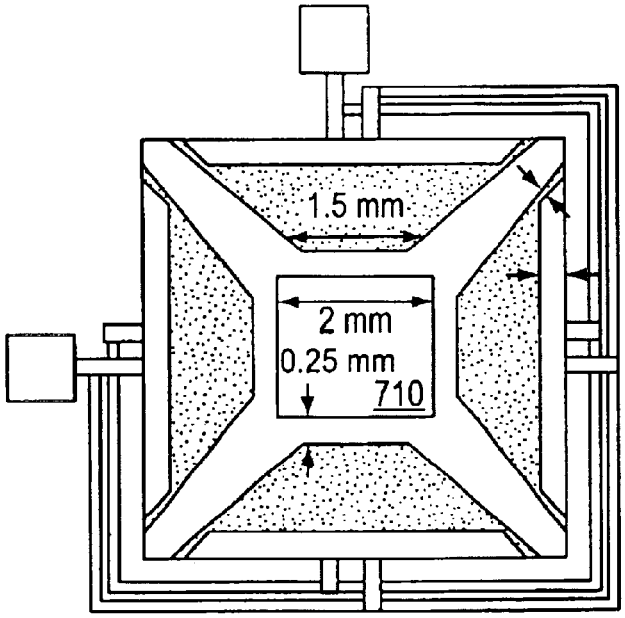

The design of FIG. 7 is similar except that no electrodes run to the center region, and there is no silicon nitride or ZnO in the center region. Rather, a coupling mass, such as aluminum, is located in the center section between the four cantilevered transducers to enhance the response to any received change in pressure.

Figure 8:
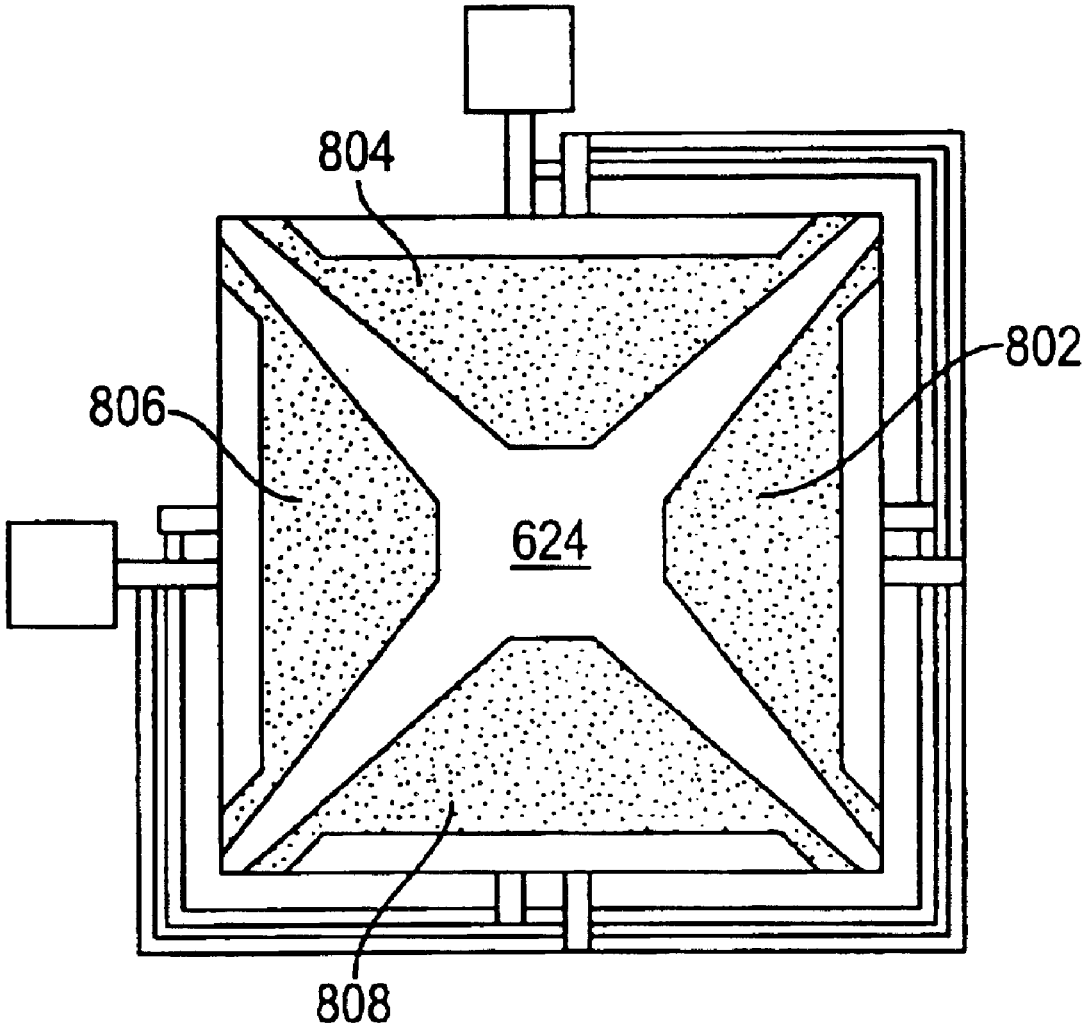

A further alternative of course as shown in FIG. 8 would be to leave the center section completely open and covered only by a portion of the parylene diaphragm film 624 which also supports the four cantilever transducers 802, 804, 806 and 808. As can be seen, in similar fashion to FIG. 6, each of these has connecting electrodes at the one supported edge, the connecting layers being defined by SiN, ZnO, and an insulating layer between the aluminum or other electrical connecting layers.

Figure 9A:
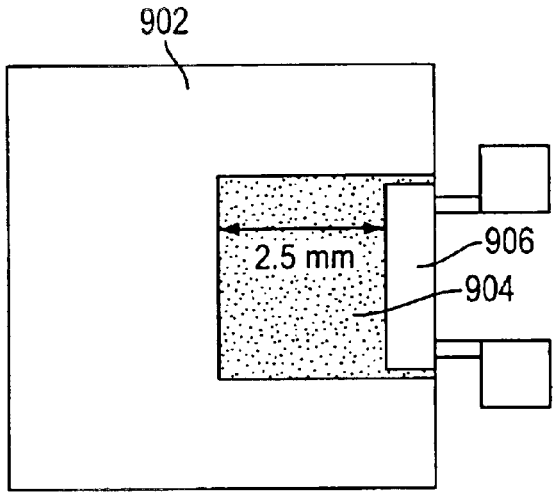
Figure 9B:
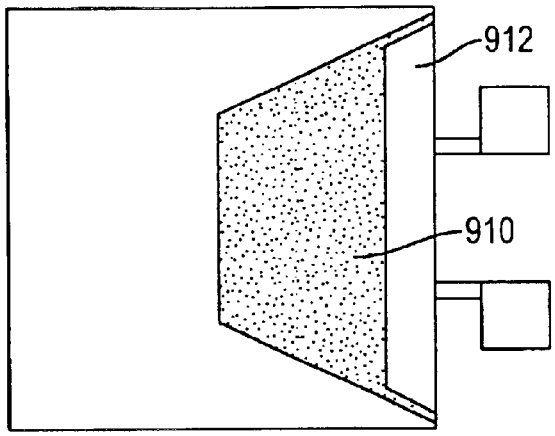
Figure 9C:
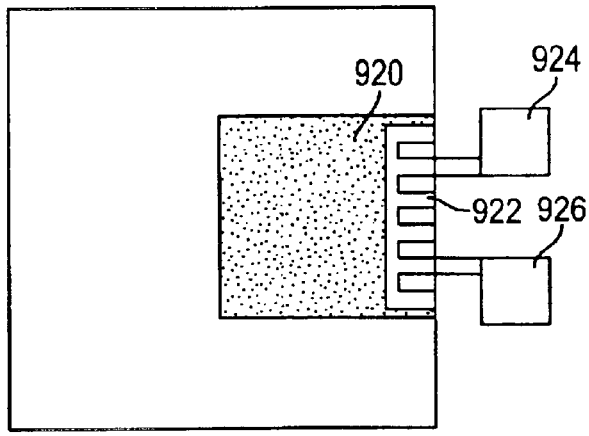

In yet another alternative, only a single cantilever shape may be used as shown in FIGS. 9A, 9B and 9C. FIG. 9A shows a rectangular transducer with a parylene layer 902 and a rectangular cantilever transducer 904 of silicon nitride and a SiN, ZnO electrode connecting layer 906 along the fastened edge. FIG. 9B is similar, except that the cantilever structure 910 is now a trapezoid in shape to provide a larger electrode connection region defined of SiN and ZnO, 912. Finally, FIG. 9C, similar to FIG. 9A, shows a rectangular cantilever transducer 920 with a reduced SiN region 922 having a series of cutouts to reduce the stiffness of the electrode region and enhance the signal delivery to the electrodes 924, 926.

Figure 10A:
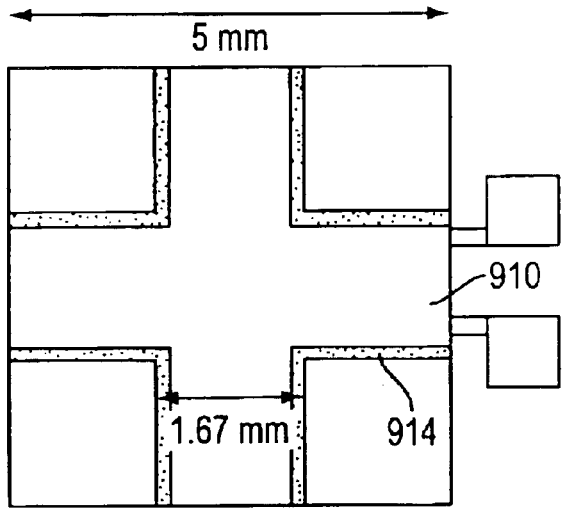
Figure 10B:
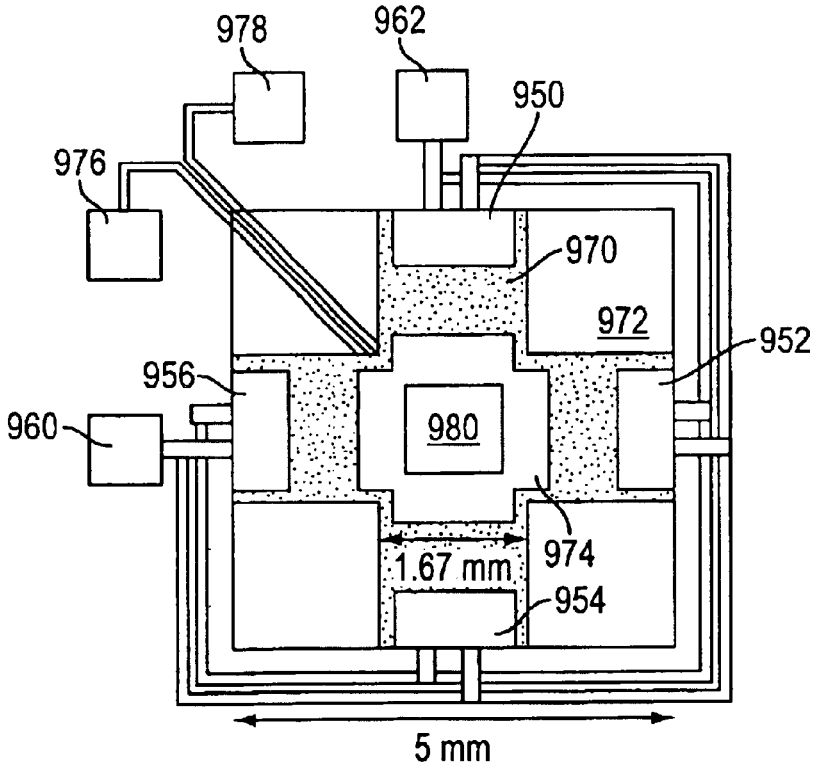

FIG. 10A shows a bridge-type electrode region which comprises the layers of SiN, ZnO and electrode connections all in bridge region 911 with the silicon nitride SiN layer 914 overlapping all edges of the bridge 910. In an alternative approach, FIG. 10B, each of the ends of the bridge comprise a rectangular electrode 950, 952, 954 and 956 at each end of the bridge and comprising the SiN, ZnO layers which establish the electrical connections to external electrodes 960, 962. The center section, which is supported from a silicon nitride layer 970, and the parylene diaphragm 972 comprises the SiN, ZnO layers 974 connected to center electrodes 976, 978. A central rectangular section defined only by the parylene diaphragm layer 980 is otherwise left open to enhance the signal response.

Other features and advantages of this invention may occur to a person of skill in the art who is studies this invention disclosure. Therefore, the scope of the invention is to be limited only by the following claims.

What is claimed is:

1. A method of fabricating a parylene diaphragm acoustic transducer comprising:

depositing backside and topside silicon nitride on a deposition surface of a silicon substrate, followed by depositing layers of first Al, insulating parylene and second Al on the topside silicon nitride layer;

depositing a second thicker parylene layer as a diaphragm;

patterning contact holes to the bottom and top Al layers;

releasing the diaphragm by patterning the backside silicon nitride;

removing portions the silicon substrate by etching to release the diphragm; and thereafter, patterning the silicon nitride top side layer.

2. A method of fabricating a parylene diaphragm acoustic transducer comprising:

depositing silicon nitride on a silicon substrate, followed by depositing a first conductive layer, an insulating layer, and a second conductive layer;

depositing a zinc oxide layer adjacent the insulating layer;

depositing a parylene layer in a form to serve as a diaphragm;

patterning contact holes to the top and bottom conductive layers;

releasing the diaphragm by removing the underlying silicon substrate; and, patterning the silicon nitride underlying the parylene diaphragm layer to provide further support for the parylene diaphragm layer.

3. A method as claimed in claim 2 wherein the insulating layer is layer of parylene which is relatively thinner than the diaphragm parylene layer.

4. A method as claimed in claim 3 wherein the zinc oxide ZnO layer is deposited over the first conductive layer after the first conductive layer is deposited and prior to the deposition of the insulating parylene layer.

5. A method as claimed in claim 3 wherein the silicon nitride is patterned to form cantilever type transducer elements supported on a bottom surface of the parylene, and wherein the zinc oxide and electrodes are patterned to only extend along an edge of each of the cantilever style transducers.

6. A method as claimed in claim 5 wherein each of the silicon nitride transducer elements is in a generally trapezoidal shape and arrayed about a center region of the parylene diaphragm layer.

7. A method as claimed in claim 3 wherein the silicon nitride layer underlying the parylene diaphragm layer is patterned to form a single cantilever type transducer including a narrow region of zinc oxide and electrode contacts extending along the side of the transducer supported from the silicon substrate.

8. A method as claimed in claim 7 wherein the cantilever type silicon nitride transducer is generally rectangular in shape.

9. A method as claimed in claim 7 wherein the transducer is a single transducer formed of the layer of silicon nitride in a generally trapezoidal shape with the single zinc oxide layer extending along the edge of the transducer supported directly from the silicon substrate.

10. A parylene diaphragm acoustic transducer comprising a silicon substrate supporting first and second conducting layers, separated by an insulating layer, and having a layer of zinc oxide ZnO in between the first and second conducting layers, and a layer of parylene serving as a diaphragm layer formed over the first and second conductive layers and formed at least in part over the zinc oxide layer.

11. A parylene diaphragm transducer as claimed in claim 10 wherein the insulating layer between the conducting layers is a thin layer of parylene and the parylene layer serving as a diaphragm is relatively thicker in extent than the parylene insulating layer.

12. A parylene diaphragm acoustic transducer as claimed in claim 10 including a silicon nitride layer underlying the parylene diaphragm layer in part, the silicon nitride layer defining in cooperation with the zinc oxide layer an acoustic transducer supported from the parylene layer.

13. An acoustic transducer as claimed in claim 12 wherein the silicon nitride layer is patterned to form one or more trapezoid shaped cantilever type acoustic transducers underlying the parylene layer and having the zinc oxide layer extending only along an edge of the silicon nitride layer that is directly supported from the underlying silicon substrate.

14. A parylene diaphragm acoustic transducer as claimed in claim 12 wherein a center region of the parylene diaphragm layer is occupied by a silicon nitride layer separate from the cantilever type silicon nitride transducer layers, and further having the zinc oxide layer at least partially overlying the silicon nitride layer and separately connected to electrode lines running to separate electrode terminals from the electrode terminals connected to the edged of the cantilever type acoustic transducers.

15. A parylene diaphragm acoustic transducer as defined in claim 14 further including a center region of the parylene diaphragm left blank by the cantilever type silicon nitride acoustic transducers, and having thereon a layer of aluminum to emphasize the movement of the parylene diaphragm.

16. A parylene diaphragm acoustic transducer as claimed in claim 12 further including a silicon nitride layer underlying the parylene diaphragm and defining a single cantilever type acoustic transducer underlying a portion of the parylene diaphragm layer, and further including the region of zinc oxide extending only along an edge of the cantilever type acoustic transducer supported from the underlying silicon substrate.

17. A parylene diaphragm acoustic transducer as claimed in claim 16 wherein the silicon nitride layer is generally rectangular in shape.

18. A parylene diaphragm acoustic transducer as claimed in claim 16 wherein the silicon nitride layer is generally trapezoidal in shape.

19. A parylene diaphragm acoustic transducer as claimed in claim 17 wherein the zinc oxide region extends along an edge of the acoustic transducer supported from the silicon substrate, and wherein both the zinc oxide layer and the silicon nitride layer defining the acoustic transducer are periodically interrupted extending therethrough to the parylene diaphragm layer so that the signal energy of the acoustic transducer is focused to an electrode layer connected to the supported edge thereof.

* * * * *